US006793567B1

(12) United States Patent
Corkill et al.

(10) Patent No.: US 6,793,567 B1
(45) Date of Patent: Sep. 21, 2004

(54) UPPER OUTERMOLD LINE SANDER

(75) Inventors: Kenneth Scott Corkill, Lancaster, CA (US); John Charles Firm, Palmdale, CA (US); Ronald Eugene Roche, Phelan, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/430,921

(22) Filed: May 7, 2003

(51) Int. Cl.[7] ..... B24B 23/00
(52) U.S. Cl. ..... 451/353; 451/350
(58) Field of Search ..... 451/353, 359, 451/350, 344, 259; 125/38

(56) References Cited

U.S. PATENT DOCUMENTS 2,702,395 A * 2/1955 Zaiger ..... 15/98
4,099,328 A * 7/1978 Schlemmer ..... 30/172
4,145,848 A 3/1979 Hutchins
4,204,292 A 5/1980 Lester et al.
4,328,645 A 5/1982 Sauer
4,660,329 A 4/1987 Hutchins
5,040,340 A 8/1991 Bischof et al.
5,239,783 A 8/1993 Matechuk
5,439,413 A * 8/1995 Lagler ..... 451/353
5,545,080 A 8/1996 Clowers et al.
6,413,157 B1 * 7/2002 Marton ..... 451/357

FOREIGN PATENT DOCUMENTS

EP 0 561 652 A1 3/1993

* cited by examiner

*Primary Examiner*—Robert A. Rose
(74) *Attorney, Agent, or Firm*—Stetina Brunda Garred & Brucker

(57) ABSTRACT

A floating sanding mechanism is provided including a handle, support arm secured to an extending from the handle and a support arm mounting plate pivotally engaged to the support arm. A counter-weight support plate pivotally engaged to the support arm mounting plate and the plurality of resilient members connect to the support arm mounting plate to the counter-weight support plate, so as to pivotally bias the counter-weight support plate in a predetermined orientation, e.g. generally parallel to the support arm mounting plate. A plurality of counter-weights are secured to the counter-weight support plate, proximate a perimeter thereof. A rotating sanding surface is mechanically coupled to the counter-weight support plate and translatable to infinite orientations therewith. The resilient members and the counter-weights are selected such that the sanding surface generally follows the contours of the surface to be sanded, overcoming the opposition of the resilient members.

13 Claims, 2 Drawing Sheets

UPPER OUTERMOLD LINE SANDER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to sanding devices and, more particularly, to a floating head sanding device useful to provide precision finishes to a product surface.

Sanders have a wide variety of applications extending from everyday home use to aerospace applications for composite technologies. Particular types of products and materials may require more of a precision finish in order to achieve optimum functionality. The size and shape of the product may also dictate the type of sanders, the type of finish, etc. Sanding techniques may also vary in accordance with the nature of the product, materials or desired finish.

In some cases large products may require the use of automated floor sanders or the like to achieve the desired finish. While the equipment to perform such operations is available, the use of such equipment may be tedious, particularly where a high precision finish is required. The degree of control available from contemporary sanding devices may be insufficient to produce sufficiently precision finishes. Moreover, the stress on workers to maintain proper precision, particularly given vibration of the sander, can stress or pressure a worker in such a manner to cause injury over prolonged periods of sanding activity. As many companies recognize, a safe and comfortable work environment is not only in the interest of the workers, but also in the interest of companies who rely upon those workers to perform skilled or touch work.

Accordingly, there exists a need to devise equipment to facilitate extended operation of precision sanders, particularly when used to sand irregular surfaces, without jeopardizing the health of the workers or detracting from their productivity. That need is particularly acute where large product areas are to be sanded.

BRIEF SUMMARY OF THE INVENTION

A floating sanding mechanism is provided including a handle, support arm secured to an extending from the handle and a support arm mounting plate pivotally engaged to the support arm. A counter-weight support plate pivotally engaged to the support arm mounting plate and the plurality of resilient members connect to the support arm mounting plate to the counter-weight support plate, so as to pivotally bias the counter-weight support plate in a predetermined orientation, e.g. generally parallel to the support arm mounting plate. A plurality of counter-weights are secured to the counter-weight support plate, proximate a perimeter thereof. A rotating sanding surface is mechanically coupled to the counter-weight support plate and translatable to infinite orientations therewith. The resilient members and the counter-weights are selected such that the sanding surface generally follows the contours of the surface to be sanded, overcoming the opposition of the resilient members.

The sanding surface is provided with a perimeter, and the counter-weights are disposable axially outward from the sanding surface perimeter. In the preferred embodiment, the counter-weights are disposable at variable locations on the counter-weight support plate, by means such as slotted threading engagement to the counter-weight support plate.

In one embodiment the counter-weights are secured to counter-weight support arms, which in turn are secured to the counter-weight support plate and extending therefrom.

Locating the center of gravity of the counter-weights proximate the perimeter of the sanding surface, or beyond, places the counter-weights proximate the fastest working portion of the sanding surface thereby enhancing the effectiveness of the sander mechanism, without requiring a worker to direct the handle and follow the contours of the surface to be sanded.

In the presently preferred embodiment the pivotal engagement of the counter-weight support plate to the support arm mounting plate is implemented by means of a rotating socket ball mechanism, which connects the support arm mounting plate and the counter-weight support plate.

DETAILED DESCRIPTION OF THE INVENTION

The present invention is described in connection with the illustrated embodiment. As such, the structural features and functional attributes of the invention are set forth in relation to the embodiment described and illustrated herein. However, as will be recognized by those skilled in the art, the invention has application to a variety of other types of sander mechanisms as well. Moreover, as will also be recognized by those skilled in the art, the illustrated embodiment may be modified to achieve additional or alternate functionality as may be required for a particular application. For example, the construction of the illustrated counter-weights may be varied as may be their mass and location relative to the mechanism. Similarly, different implementations of resilient members may be utilized to orient the counterweights and the sanding surface in different positions relative to the support arm mounting plate. These and other modifications or enhancements of the present invention may be implemented without departing from the broader aspects of the invention as described herein.

Figure 1:
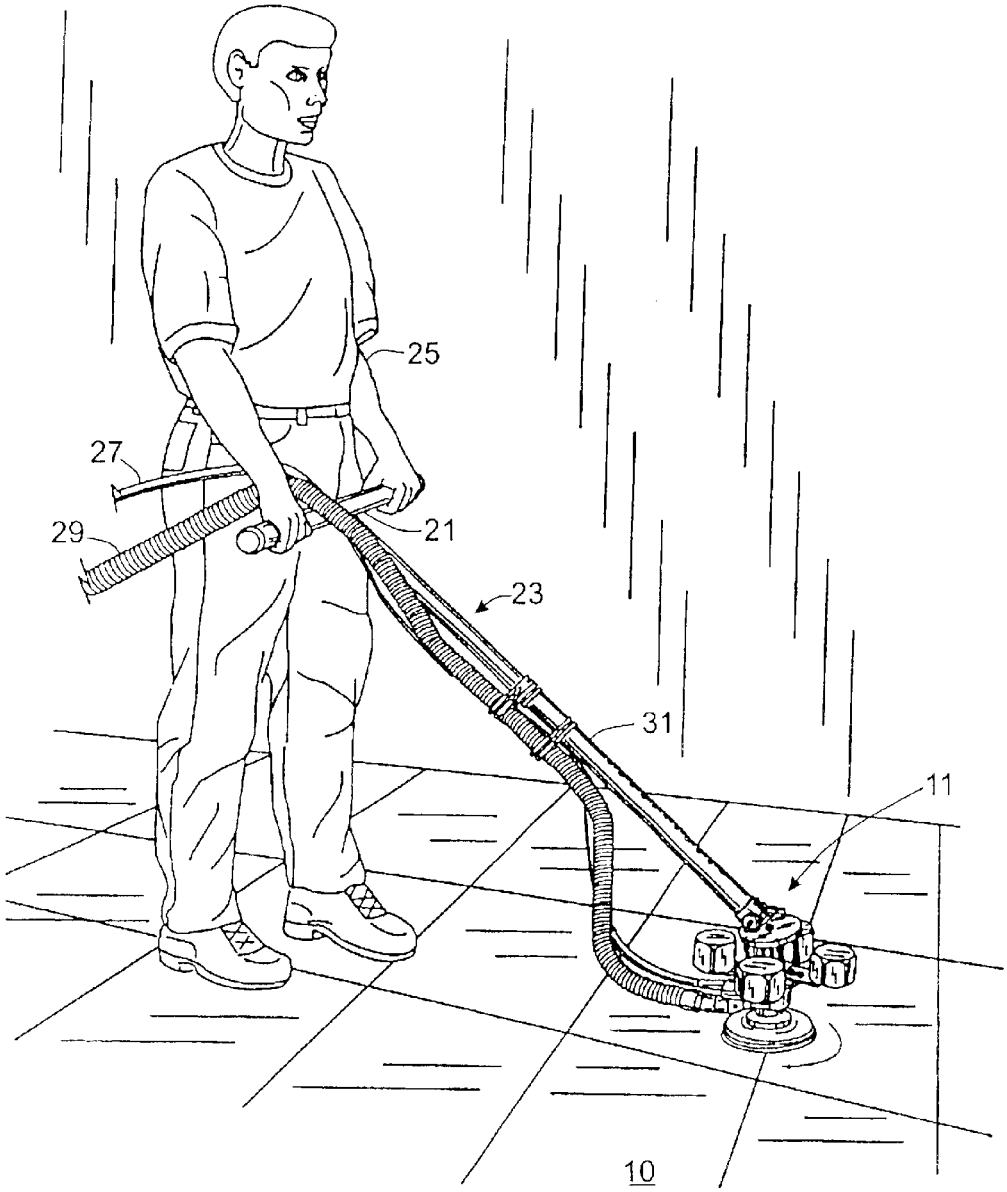
FIG. 1 is an illustration of the present invention in use to sand a working surface.

Referring to FIG. 1 wherein sanding mechanism 11 is shown in use to sand surface 10. The sanding mechanism 11 is illustrated as a floor sander that is moved about to sand the surface 10. Sanding mechanism 11 includes handle 21 connected to support arm 23. The sanding mechanism 11 is translated along the surface 10 by user movement of the handle. In the illustrated embodiment the sanding mechanism 21 is powered by pressurized air flowing through air conduit 27. Particulate released by the action of sanding mechanism 10 is removed by vacuum applied through vacuum conduit 29. The length of the support arm 23 may be varied by constructing the support arm of multiple portions that are extendable relative to one another. In use, the length of the support arm may be fixed by means such as a tightening collar, or by selectively extending a locking member through perforations 31, formed in the support arm 23.

Figure 2:
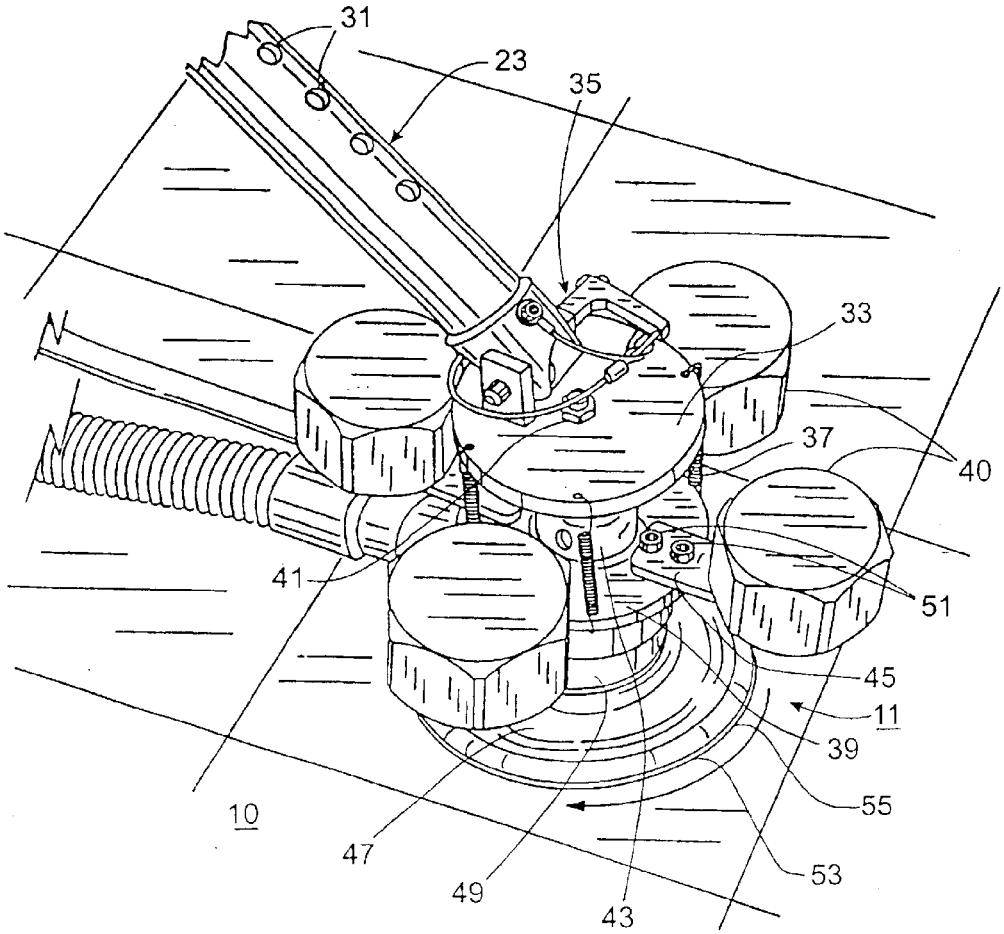
FIG. 2 is an enlarged view of the sanding mechanism shown in FIG. 1.

As shown more particularly in FIG. 2, the support arm 23 may be pivotally connected to support arm mounting plate 33, by means such as pivotal engagement mechanism 35. In the presently preferred embodiment the pivotal engagement mechanism 35 receives and pivotally engages the support arm 23 to allow the support arm 23 and handle 21 to be operated at different vertical orientations relative to the surface 10.

In the illustrated embodiment, plurality of springs 37 connect the periphery of support arm mounting plate 33 to the periphery of counter-weight mounting plate 39. Further, the support arm mounting plate 33 is pivotally engaged to counter-weight support plate 39 by means of fastener 41 which extends from pivoting socket ball mechanism 43.

Pivoting mechanism 43 and counter-weight support arms 45 are rigidly connected to the counter-weight support plate 39.

Rotating sander mounting plate 47 is rotatably connected to drive housing 49, which in turn is secured to counter-weight mounting plate 39.

Consequently, movement of the handle 21 and support arm 23 will cause the handle support plate 33 to pivot with respect to collar 43, counter-weight mounting plate 39 and sander mounting plate 47. The resilient action of springs 37 will urge the sander mounting plate to generally follow the motion of handle 21 and support arm 23, subject to the stiffness of springs 37, the mass of counter-weights 40 and other portions of the sanding mechanism connected thereto. The springs 37 will also dampen the transmission of vibrations from the rotating portions of the sanding device to the user 25.

The counter-weights 40 are secured to the counter-weight support plate 39 by engagement to the counter-weight support arm 45. In the presently preferred embodiment the counter-weights 40 are threadably engageable to support plate 45 so as to be easily disengageable from the support plate 45, and replaced with counter-weights of different mass, as appropriate to a particular application. As such, the downward pressure of sanding device 11 upon surface 10 may be varied in accordance with the surface being sanded and the "touch" finish that may be required.

The radial spacing of counter-weights 40 from support plate 39 and therefore from the center axis of sanding device 11, may be adjusted by varying the length of support arm 45. As a result, the counter-weights 40 can be disposed at a variable distance, from the center axis of the sander device 11 as desired.

In one alternate embodiment, the support plate 45 may be provided with a slot to receive fasteners 51 at variable locations along the length of the slot, to variably define the radial position of counter-weights 40 relative to the center axis of sanding mechanism 11.

In practice, the counter-weights 40 may be positioned to be centered beyond the perimeter 53 of rotating sander mounting plate 47, to which sanding surface 53 is mounted. As a result, the counter-weights 40 are disposed to apply downward pressure about the perimeter of the sanding surface 53. As will be recognized by those skilled in the art, the perimeter region of sanding surface 53 is the fastest moving portion of sanding surface 53. Put otherwise, the perimeter of sanding surface 53, disposed on the underside of sander mounting plate 47, is the location where fastest sanding action and greatest wear typically occurs. By locating the counter-weights proximate or beyond the perimeter of sanding surface 53, a moment arm is defined which urges the perimeter of sanding surface 53 into working contact with surface 10 to facilitate the abrasive action of sanding mechanism 11, and maintains the sanding surface 55 in functional contact with the surface 10.

The construction of the sanding mechanism 11 including the resilient pivotal engagement of the support arm and the counter-weight support plate allows the sanding surface 53 to follow the contours of the surface 10, while mitigating the requirement for rigid directional activity by the user, and also mitigating the transmission of vibrations to the user. As such, the user may operate the sanding mechanism 10 for extended periods without experiencing the level of discomfort typically associated with conventional sanding mechanisms, and without detracting from the precision of the finish.

As noted above, various modifications of the present invention may be implemented without departing from the basic objectives and advantages thereof. For example, the counter-weights 40 may be selected to be of different weights, to bias the mechanism in a particular direction or to accommodate additional weight on one side of the sanding mechanism, e.g. resulting from the presence of hoses and connectors and the support arm 23. Additionally, the springs 37 may be replaced by other resilient members, or the function thereof may be integrated into the pivoting mechanism 43, which may be resiliently pivotable. Different constructions may also be provided to implement the functions of counter-weights 40, and counter-weight support plates 45. Consequently, these and other alternate implementations are intended to be encompassed within the spirit and scope of the present invention, as set forth herein.

What is claimed is:

1. A sander mechanism comprising:

a) a handle;

b) a support arm secured to and extending from the handle;

c) a support arm mounting plate pivotally engaged to the support arm;

d) a counter-weight support plate pivotally engaged to the support arm mounting plate;

e) a plurality of resilient members connecting the support arm mounting plate to the counter-weight support plate so as to pivotally bias the counter-weight support plate in a predetermined orientation;

f) a plurality of counter-weights secured to the counter weight support plate proximate a perimeter thereof; and g) a rotating sanding surface mechanically coupled to the counter-weight support plate and translatable therewith;

h) wherein the sanding surface is urged into working contact with the surface to be sanded independent of handle movement.

2. The mechanism as recited in claim 1, wherein the sanding surface has a perimeter, and the counter-weights are disposable axially outward from the sanding surface perimeter.

3. The mechanism as recited in claim 1, wherein the counter-weights are disposable at variable locations on the counter-weight support plate.

4. The mechanism as recited in claim 1, wherein the resilient members comprise springs.

5. The mechanism as recited in claim 1, further including a plurality of counter-weight support arms secured to the counter-weight support plate and extending therefrom, the counter-weights being engaged to respective ones of the plurality of counter-weight support arms.

6. The mechanism as recited in claim 1, further including a pivoting socket ball mechanism, pivotally engaging the support arm mounting plate and the counter-weight support plate.

7. A sander mechanism comprising, a) a support arm mounting plate;

b) a counter weight support plate pivotally engaged to the support arm mounting plate;

c) a plurality of resilient members connecting the support arm mounting plate to the counter weight support plate; and d) a rotating sanding surface mechanically coupled to the counter-weight support plate and translatable therewith.

8. The mechanism of claim 7 further comprising a plurality of counter-weights secured to the counter weight support plate proximate a perimeter thereof.

9. The mechanism of claim 7, wherein the sanding surface has a perimeter, and the counter-weights are disposable axially outward from the sanding surface perimeter.

10. The mechanism of claim 7 wherein the counter-weights are disposable at variable locations on the counter-weight support plate.

11. The mechanism of claim 7, wherein the resilient members comprise springs.

12. The mechanism of claim 7, further including a plurality of counter-weight support arms secured to the counter-weight support plate and extending therefrom, the counter-weights being engaged to respective ones of the plurality of counter-weight support arms.

13. The mechanism of claim 7, further including a pivoting socket ball mechanism, pivotally engaging the support arm mounting plate and the counter-weight support plate.

* * * * *